US005968205A

United States Patent [19]

Hartmann et al.

[11] Patent Number: 5,968,205

[45] Date of Patent: Oct. 19, 1999

[54] INSTALLATION AND A PROCESS FOR PATTERNING A WEB OF TEXTILE MATERIAL

[75] Inventors: Werner Hartmann, Krefeld; Alfred Keller, Willich; Bernd Pesch, Kempen, all of Germany

[73] Assignee: Eduard Kusters Maschinenfabrik GMBH & Co. KG, Krefeld, Germany

[21] Appl. No.: 08/894,894

[22] PCT Filed: Dec. 28, 1995

[86] PCT No.: PCT/DE95/01867

§ 371 Date: Aug. 4, 1997

§ 102(e) Date: Aug. 4, 1997

[87] PCT Pub. No.: WO96/23923

PCT Pub. Date: Aug. 8, 1996

[30] Foreign Application Priority Data

Feb. 3, 1995 [DE] Germany ..... 195 03 520

[51] Int. Cl.[6] ..... D06B 3/10; D06B 23/20

[52] U.S. Cl. ..... 8/149.1; 8/149.3; 8/151; 8/158; 68/5 D; 68/13 R; 68/18 R

[58] Field of Search ..... 8/149.1, 149.3, 8/151, 158; 68/5 D, 5 E, 13 R, 18 R

[56] References Cited

U.S. PATENT DOCUMENTS 4,418,433 12/1983 Moreland et al. ..... 8/149.1

FOREIGN PATENT DOCUMENTS 27 08 000 9/1977 Germany .
34 40 948 5/1986 Germany .

OTHER PUBLICATIONS

Rouette et al., "Fundamentals of Textile Finishing," 1989 (13 Ed.), pp. 620–623.

*Primary Examiner*—Philip R. Coe
*Attorney, Agent, or Firm*—Kenyon & Kenyon

[57] ABSTRACT

A textile web, for example, a carpet web, is provided with a patterning agent including a thickening agent and subsequently steamed in a steamer. The agent residues remaining on the textile web are at least partially removed by mechanical means, and cleaned and decolorized in a cleaning unit, leaving a virtually pure thickening agent which can be reused for preparing a new batch of patterning agent in the batching tank.

9 Claims, 2 Drawing Sheets

INSTALLATION AND A PROCESS FOR PATTERNING A WEB OF TEXTILE MATERIAL

FIELD OF THE INVENTION

The present invention relates to a process and installation for patterning a web of textile material.

BACKGROUND OF THE INVENTION

Within the meaning of the present invention, "patterning" is to be considered primarily as colored patterning, in which context one should think not only of a true illustration or pattern, but of solid-shade dyeing as well. The active manner in which the patterning on the web is accomplished is not important for the present invention. In many cases, it will be a printing process, but patterning processes that also come into consideration are a dropping, pouring or spraying of the pattern on the web, or even where the web is dipped into a patterning liquor.

The present invention concerns patterning processes of this type, where a thickening agent must be present on the web. This is primarily the case with printing processes to prevent the patterning agent from running, thus forming a clean contour, or to prevent the patterning agent from penetrating too quickly into the depth of the textile material. The use of thickening agents in textile printing is described in the book "Fundamentals of Textile Finishing" by M. Peter and H. K. Rouette, 13th edition (1989), pages 620 to 623, and a number of suitable substances are enumerated. Of course, mixtures of several suitable substances must also be regarded as thickening agents.

In the case of printing, the thickening agent is in the applied medium, i.e., the printing paste. This also holds true when a thickening agent must be used in carpet dyeing to prevent the applied patterning agent from sinking too quickly into the pile, which in the case of carpets is quite high, thus assuring that the tips of the fibers receive enough dye, so that a frosting effect does not develop. The thickening agent added to the dyeing liquor in these cases also keeps the liquor on the top areas of the fibers for a sufficient time.

However, there are also cases when thickening agent is not applied together with the patterning agent, but is applied beforehand. An example for this can be gathered from the German Patent No. 27 08 000 A1, in which the thickening agent (gum) is used as a dye retardant and is applied in a coating on a carpet web, upon which a non-repeating pattern is subsequently dropped using dyeing liquors. However, even here, when the patterning is completed and the goods are in the steamer, thickening agents are present.

These thickening agents must be removed again from the web after the steaming process. This is a difficult task and requires considerable expenditure for washing. Many attempts have been made to facilitate the removal of the thickening agent. For example, the thickener has first been moistened, whereupon it has passed through a soaking section in order to let the thickener swell due to the moisture. After that, it is supposed to be easier to wash out.

Until now, the washing expenditure to remove the thickener was always considerably greater than in the normal dyeing process where no thickening agents are necessary.

At the end of the steamer, the thickening agents form a true layer on the web. It has already been undertaken to mechanically remove this layer in the end region of the steamer by doctoring, so that at least a substantial portion of the thickening agent was already removed from the web without a washing process, thus the washing process was relieved accordingly (as shown in German laid open print No. 34 40 948).

However, all these known measures were from the aspect of merely removing the thickening agent, which subsequently had to be disposed of in a costly manner.

SUMMARY OF THE INVENTION

An underlying object of the present invention is to improve the patterning process of this type which works with thickening agents.

Thus, in this case, the stress is not on the mere removal of the thickener, but on its recovery and reuse in preparing a new batch of patterning agent. Therefore, the present invention has both an ecological aspect, in that the repeated use of the thickening agents substantially reduces the outlay for waste disposal, and an economic aspect, in that the repeated use of the expensive thickening agents yields a cost savings which amortizes the costs of the additional equipment in a relatively short time.

To be understood as "agent residues" are the totality of unbound substances on the web and its fibers, thus not only the residues of the applied patterning agent, but also the residues from those processing agents applied in previous treatment steps, such as sizing, finishing and similar agents, which adhere to the fibers. These constituents are less affected during the mechanical removal of the agent residues. They remain predominantly on the web and are first removed during the subsequent washing operation. Rather, the mechanically removable constituents contain mainly the residues of the patterning agent, such as the printing paste, that comprises predominantly the thickening agent, and which in this manner is able to be separated from the unwanted processing agents, such as the sizing and finishing agents, etc., which cannot accumulate in the portion to be reused.

The "cleaning" of the mechanically removed agent residues is carried out from two standpoints:

On one hand, a mechanical cleaning is carried out by a screening or filtering which removes impurities from the material such as lint and the like collected during the removal of the agent residues by mechanical means.

Then, a decolorizing treatment can follow this mechanical cleaning. It may be so, in the case of many color patternings, and thus dyeings, that 99% and more of the dyestuffs contained in the patterning agent absorbs into the fibers, and for that reason, the agent residues, comprising quite predominantly the remnant thickening agent, remain almost colorless. Since, however, these dyestuff residues can accumulate during repeated use of the thickening agent, a separate decolorizing treatment is advisable.

The decolorizing treatment is described next. The mechanically cleaned agent residues are applied, as in a dyeing process, with a suitable coating device on a web-type, permeable fabric made of textile fibers which are easily dyeable by the patterning dye. The fabric can be a woven fabric, or else a non-woven fabric made of the textile fibers. The agent residues on the fabric are then sucked through the fabric, the dyestuffs still contained in the agent residues readily transferring onto the appropriately selected fabric fibers. Thus, the dyes still contained in the agent residues are, so to speak, "dyed away" out of them. A virtually pure thickening agent remains which can be reused. The fabric is either discarded, or is itself decolorized by a suitable process, to be usable again, if desired.

One important aspect of the procedure described is that both the removal of the thickening agent from the web and its cleaning are carried out without the aid of water, so that the retrieved thickening agent can be reused as is, without energy-costly water extraction.

DETAILED DESCRIPTION

Figure 1:
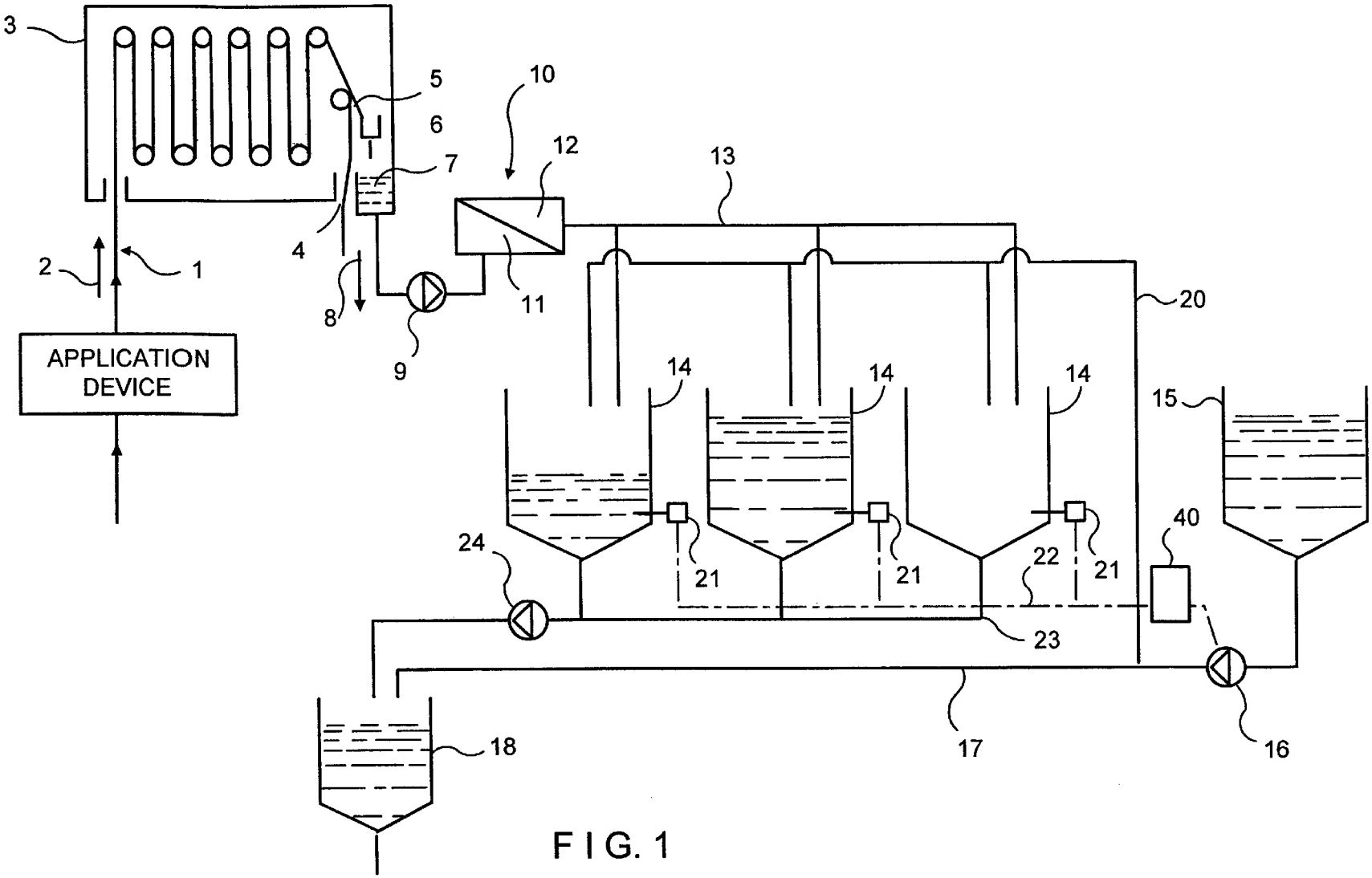
FIG. 1 shows a schematic view of the recovery section of a patterning installation.

In the exemplary embodiment, the textile web denoted with 1 in FIG. 1 is a carpet web which, at a location upstream in the figure representation, has been provided via an application device with an application of a patterning agent containing thickening agents. In the exemplary embodiment, it is a thickened printing paste.

Thus, after the application of the patterning agent, the patterning agent and the thickening agent are present on web 1 at the same time. Web 1 enters in the direction of arrow 2 into a steamer 3 in which the dyes from the patterning agent absorb into the fibers of web 1. At the end of the run-through, this process is complete, and there remains on the web an agent residue which comprises small residues of dye, possible slight residues of another type and the entire thickening agent. The thickening agent is found as a kind of coating on the pile side of the web when it is about to leave steamer 3 at outlet 4. Provided in this region of steamer 3 is a doctor blade 5 which wipes off web 1 and mechanically removes from the web a substantial portion of the agent residue on the web 1, for instance 50 to 70%, and collects it in a channel 6, from where it enters into a working tank 7 at outlet 4 of the steamer. The doctor blade or another mechanical removal device can also be arranged outside of the steamer, close to outlet 4.

The intention is not to thoroughly remove the agent residue remaining on the web. Contained in the agent residue is, namely, also residue from sizing agents, finishing agents and the like, which remains on the fibers and, to a lesser extent, in the area of the thickening agent located at the top on the pile. Mainly, these portions of the agent residue remain on web 1 during the wiping-off process and do not arrive in working tank 7 with the wiped-off portion of the agent residue. The unwanted components such as sizers, finishing agents and the like are washed out when web 1, after leaving steamer 3 at outlet 4, is transferred in the direction of arrow 8 into a washing installation (not shown).

The wiped-off agent residue is transferred out of working tank 7 by means of a pump 9 into a cleaning device 10. Cleaning device 10 comprises two aggregates 11 and 12. The wiped-off agent residue arrives first of all in aggregate 11, which is a screen and filter unit for the removal of mechanical impurities such as lint and the like collected when wiping off web 1.

The mechanically precleaned agent residue then arrives in a decolorizing unit 12 which gets out from the agent residue the small portions of dye which were not absorbed into web 1 in steamer 3, but remained in the agent residue. Decolorizing unit 12 will be described in detail with the aid of FIG. 2.

The medium leaving decolorizing unit 12 in conduit 13 can no longer be described as "agent residue", but comprises a virtually pure thickening agent which can be delivered into supply tank 14. Only one supply tank 14, as such, would be necessary. However, the quality of the thickening agent present in conduit 13 can fluctuate from yardage to yardage of web 1. Therefore, it is recommended to collect the thickening agent separately for each yardage. For this reason, three supply tanks 14 are provided in the exemplary embodiment, into which the thickening agent conveyed in conduit 13 can be selectively delivered.

Besides the three supply tanks 14, provision is also made for a tank 15 having thickening-agent stock solution, and from which the thickening-agent stock solution can be transferred by means of a pump 16 via a conduit 17 into a batching tank 18 for preparing further patterning agent, for example, further printing paste.

Alternatively or in addition, thickening-agent stock solution can be transferred via conduit 20 selectively into one of the supply tanks 14 in order to adjust, in the necessary manner, the thickening agent located therein, whose quality can be different in the three supply tanks 14. This adjustment can take place automatically, in that the properties of the thickening-agent quantities in the individual supply tanks 14 are measured by suitable measuring devices 21. The measured values are each fed via a line 22 to a controlling unit 40 which controls metering pump 16 in such a way that it supplies the thickening-agent stock solution to the individual supply tanks 14 in the quantity needed in each case.

The thickening agent is selectively removed from the individual supply tanks 14 by means of a pump 24 via a conduit 23 and fed to batching tank 18 for preparing further patterning agent.

Figure 2:
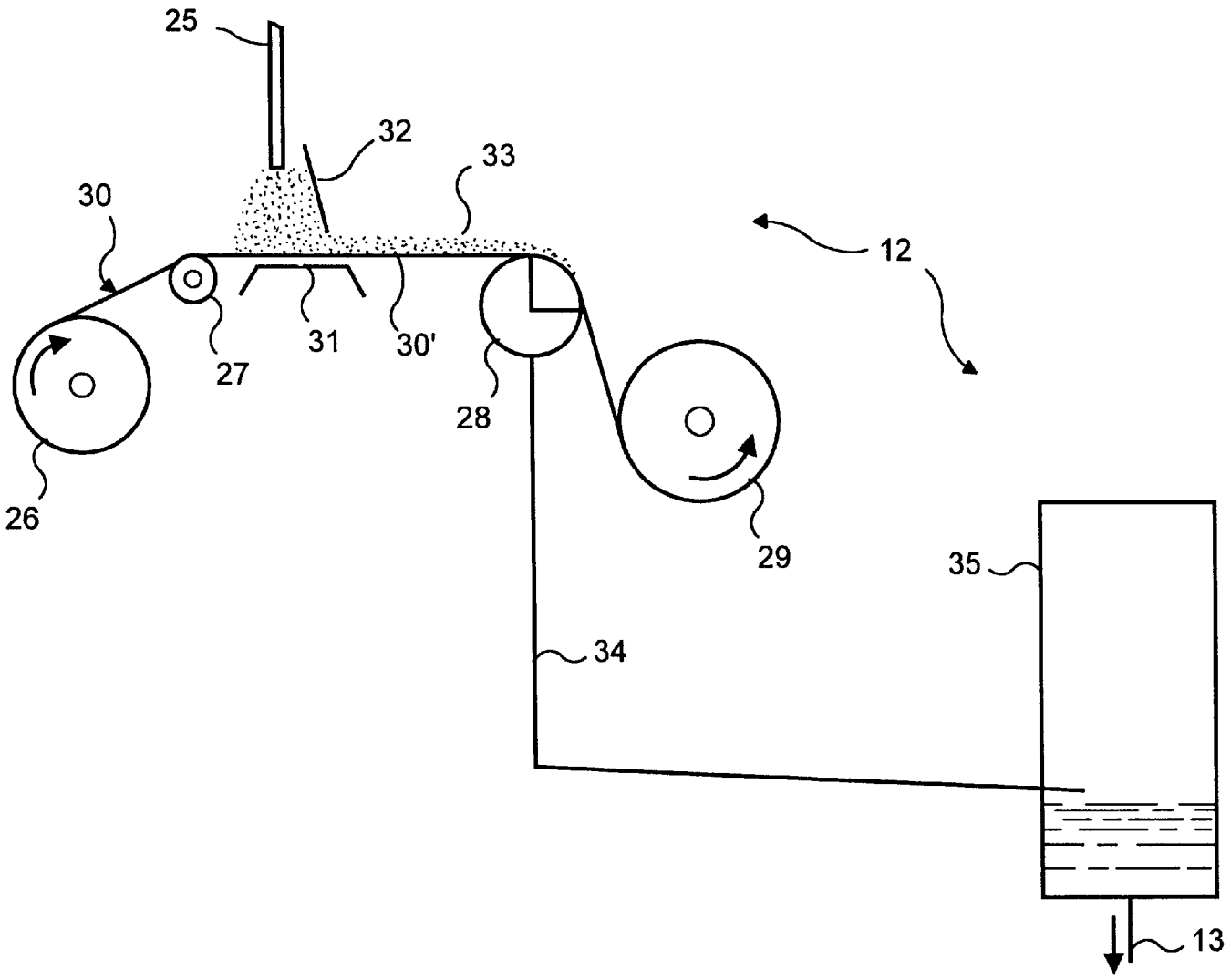
FIG. 2 shows a schematic side view of a decolorizing device.

FIG. 2 shows a relevant decolorizing unit 12. The quantity of agent residue leaving screen and filter unit 11 is delivered via a supply tube 25 onto a horizontally guided section 30' of a web-type fabric 30 that represents a woven fabric, a knit fabric or a non-woven fabric made of fibers able to be dyed particularly easily by the dyestuffs contained in the patterning agent for the carpet. In the exemplary embodiment shown, the fabric is reeled off a roller 26, conducted in the horizontal section 30' by way of a support roll 27 and a suction tube 28 effective over the width of fabric 30, and subsequently reeled again onto a roller 29. The agent residue is delivered through, supply tube 25 at a location on the upper side of fabric 30 where it is supported on the back side by a sliding plate 31. The applied quantity of agent residue is smoothed out by means of a coating knife 32, arranged on the top side, to form a uniform coating 33 which, when passing the entrance of suction tube 28, is sucked through fabric 30 into the suction tube 28.

In this context, the small quantities of dye still contained in the agent residue transfer onto fabric 30, so that virtually colorless thickening agent comes out in conduit 34, the thickening agent being separated in separator 35 from the stream of suction air, so that thickening agent that is free of air arrives in conduit 13, from where it is further processed in the manner described in connection with FIG. 1.

We claim:

1. A process for patterning a web of textile fabric comprising the steps of:

applying a patterning agent to the web;

adding a thickening agent to the web;

guiding the web provided with the patterning agent and the thickening agent through a steamer;

at least partially removing agent residues remaining on the web by mechanical means, wherein the web still substantially exhibits the temperature of the steamer;

cleaning the removed agent residues without dilution with water so that the removed agent then consists of a virtually pure thickening agent;

subjecting the virtually pure thickening agent to a decolorizing treatment, wherein the decolorizing treatment follows the step of cleaning, and reusing the virtually pure thickening agent for preparing a new batch of patterning agent.

2. The process as defined by claim 1, wherein the step of cleaning comprises a mechanical cleaning by screening and filtering to remove impurities such as lint and the like.

3. The process as defined by claim 1, wherein the decolorizing treatment comprises the steps of:

applying the virtually pure thickening agent onto a web-type permeable fabric made of textile fibers which are easily dyeable by the patterning dye; and drawing through the fabric the dyes still contained in the virtually pure thickening agent being transferred onto the fabric.

4. An installation for patterning a web of textile material comprising:

means for the continuous conveyance of a textile web in its lengthwise direction along a treatment section;

an application device, in the treatment section, for applying a patterning agent and a thickening agent onto the textile web, wherein the patterning agent and the thickening agent are applied in one of a simultaneous manner and a separate manner;

a steamer arranged downstream of the application device; and an agent residue removal device, arranged in an area of an outlet of the steamer outlet, for mechanically removing from the textile web a substantial portion of an agent residue containing the thickening agent;

a collection and conveyance device for collecting and further conveying the removed agent residue;

a cleaning device for cleaning the agent residue without water to recover a virtually pure thickening agent;

a decolorizing device downstream of the cleaning device; and a reuse device for feeding back the virtually pure thickening agent to reuse it for preparing a new batch of patterning agent.

5. The installation as defined by claim 4, wherein the agent residue removal device comprises:

a doctor-blade arrangement, effective over the width of the textile web, for acting upon the textile web from an application side.

6. The installation as defined by claim 4, wherein the cleaning device comprises one of a lint screen and a filter.

7. The installation as defined by claim 4, wherein the decolorizing device comprises:

an applicator device, by means of which the virtually pure thickening agent is applied onto an advancing web-type fabric of textile fibers easily dyeable by dyestuffs of the patterning agent;

a suction device arranged downstream of the applicator device, by means of which the applied virtually pure thickening agent is suctioned off through the fabric; and a separator to separate the virtually pure thickening agent from the suctioned-off air stream.

8. The installation as defined by claim 7, wherein the web-type fabric is unrolled from a wind-off roller and conducted across the suction device to a wind-up roller, and wherein the applicator device and the suction device are connected in series in the section.

9. The installation as defined by claim 4, further comprising:

a measuring device for measuring at least one property of the recovered virtually pure thickening agent; and a supply tank for a thickening-agent stock solution which can be supplied in a regulated manner from the supply tank to adjust at least one thickening-agent property when preparing a new batch of patterning agent.

* * * * *